US005198842A

United States Patent [19]

Fujino et al.

[11] Patent Number: 5,198,842

[45] Date of Patent: Mar. 30, 1993

[54] IONOGRAPHIC IMAGE FORMING APPARATUS

[75] Inventors: Makoto Fujino; Masakazu Shinozuka; Yoshinori Miyazawa; Hideo Yamazaki, all of Nagano, Japan

[73] Assignee: Seiko Epson Corporation, Tokyo, Japan

[21] Appl. No.: 779,242

[22] Filed: Oct. 18, 1991

[30] Foreign Application Priority Data

Oct. 24, 1990 [JP] Japan ..... 2-286239

[51] Int. Cl.[5] ..... G03G 15/00

[52] U.S. Cl. ..... 346/159; 355/279

[58] Field of Search ..... 346/159; 361/221; 355/219, 279; 430/33, 53, 126

[56] References Cited

U.S. PATENT DOCUMENTS 4,357,618 11/1982 Ragland ..... 346/159
4,363,070 12/1982 Kisler ..... 361/221 X
4,365,549 12/1982 Fotland et al. ..... 346/159 X
4,535,345 8/1985 Wilcox et al. ..... 346/159
4,799,070 1/1989 Nishikawa ..... 346/159
4,879,194 11/1989 Snelling ..... 346/159 X
4,891,656 1/1990 Kubelik ..... 346/159 X
4,956,670 9/1990 Masuda et al. ..... 346/159 X
5,063,397 11/1991 Jansen et al. ..... 346/153.1

*Primary Examiner*—A. T. Grimley
*Assistant Examiner*—Robert Beatty
*Attorney, Agent, or Firm*—Sughrue, Mion, Zinn, Macpeak & Seas

[57] ABSTRACT

An image forming apparatus includes a thin endless filmm on which is formed a latent electrostatic image, the endless film having heat-resistant and dielectric properties, a transfer mechanism for transferring the endless film, a latent electrostatic image recording head disposed outside the endless film for recording a latent electrostatic image on the endless film, a developing unit disposed outside the endless film for developing the latent electrostatic image on the endless film by placing toner particles in close proximity to or bringing the toner particles into contact with the endless film, a back electrode and a heater disposed inside the endless film, a pressure roller opposed to the heater with respect to the endless film, and a discharge unit disposed outside the endless film for discharging the latent electrostatic image. Alternately, the endless film can be formed by depositing a thin heat-resistant dielectric layer on the surface of a thin, conductive endless film, in which case the back electrode can be omitted.

26 Claims, 3 Drawing Sheets

IONOGRAPHIC IMAGE FORMING APPARATUS

BACKGROUND OF THE INVENTION

In a conventional image forming apparatus, a photoreceptor drum having photoconductive properties is uniformly charged and selectively exposed so that a latent electrostatic image is formed on the photoreceptor. The latent electrostatic image is developed with toner particles to form a toner image on the photoreceptor. Subsequently the toner image is electrostatically transferred from the photoreceptor to a recording medium such as paper. The record medium bearing the toner image is passed through a fusing/fixing unit including a pressure roller and a heater roller so that the toner image is fixed on the media.

In another conventional image forming apparatus, without the exposure process, a latent electrostatic image is directly formed on a dielectric drum by an ion-current control head known as a latent electrostatic image recording head. The latent electrostatic image formed on the dielectric drum is developed to form a toner image on the dielectric drum. The toner image is transferred and fixed to a record medium using a pressure roller. (See, for example, "Imaging," part 2, p. 209, edited by Electrophotography Academy).

The image forming apparatus using the photoreceptor drum requires a prescribed length of an optical path from the exposing stage to the drum surface of the photoreceptor. Since the transfer stage and the fixing stage are separately mounted, the transfer unit and the fixing unit must be separately installed. Because of the possibility of degrading the performance of the photoreceptor drum due to heat, it is difficult to install the photoreceptor in close proximity to the fixing unit. For the above two reasons, reduction of the overall size of the image forming apparatus is difficult. Further, 100% transfer efficiency is impossible. Owing to this, toner is inevitably left on the photoreceptor. For removing the residual toner, a cleaner must be provided. For receiving the toner removed by the cleaner, a waste toner receptacle must be provided.

In an image forming apparatus using an ion-current control head, recording electrodes with holes for forming dots as picture elements (pixels) are arrayed in a zig-zag fashion. The dielectric drum, however, has a certain curvature. These two facts make it difficult to obtain uniform sizes and shapes of all the dots. Additionally, use of the pressure fixing process causes an unnatural luster on the record medium.

SUMMARY OF THE INVENTION

The present invention has been made in view of the above circumstances and has an object the provision of an image forming apparatus which is capable of forming dots all having the same size and shape, and of concurrently performing the transfer and fixing processes without entailing the residual toner after the transfer and the unnatural luster, and does not require the space for securing the prescribed length of the optical path, the cleaner, and the waste toner receptacle, and consequently is small in size.

To achieve the above object, the first invention provides an image forming apparatus comprising: a thin endless film on which is formed a latent electrostatic image, the endless film having heat-resistance and dielectric properties; a transfer mechanism for transferring the endless film; a latent electrostatic image recording head, disposed outside the endless film, for recording a latent electrostatic image on the endless film; a developing unit, disposed outside the endless film, for developing the latent electrostatic image on the endless film by placing toner particles in close proximity to, or bringing the toner particles into contact with, the endless film; a back electrode and a heater disposed inside the endless film; a pressure roller opposed to the heater with respect to the endless film; and a discharge unit, disposed outside the endless film, for discharging the latent electrostatic image.

The invention also provides an image forming apparatus comprising: a thin endless film for bearing a latent electrostatic image, the endless film being formed by depositing a thin heat-resistant dielectric layer on the surface of a thin, conductive endless film; a transfer mechanism for transferring the endless film; a latent electrostatic image recording head, disposed outside the endless film, for recording a latent electrostatic image on the endless film; a developing unit, disposed outside the endless film, for developing the latent electrostatic image on the endless film by placing toner particles in close proximity to, or bringing the toner particles into contact with, the endless film; a back electrode and a heater disposed inside the endless film; a pressure roller opposed to the heater with respect to the endless film; and a discharge unit, disposed outside the endless film, for discharging the latent electrostatic image.

DESCRIPTION OF THE PREFERRED EMBODIMENTS

Preferred embodiments of the present invention will now be described in detail.

Figure 1:
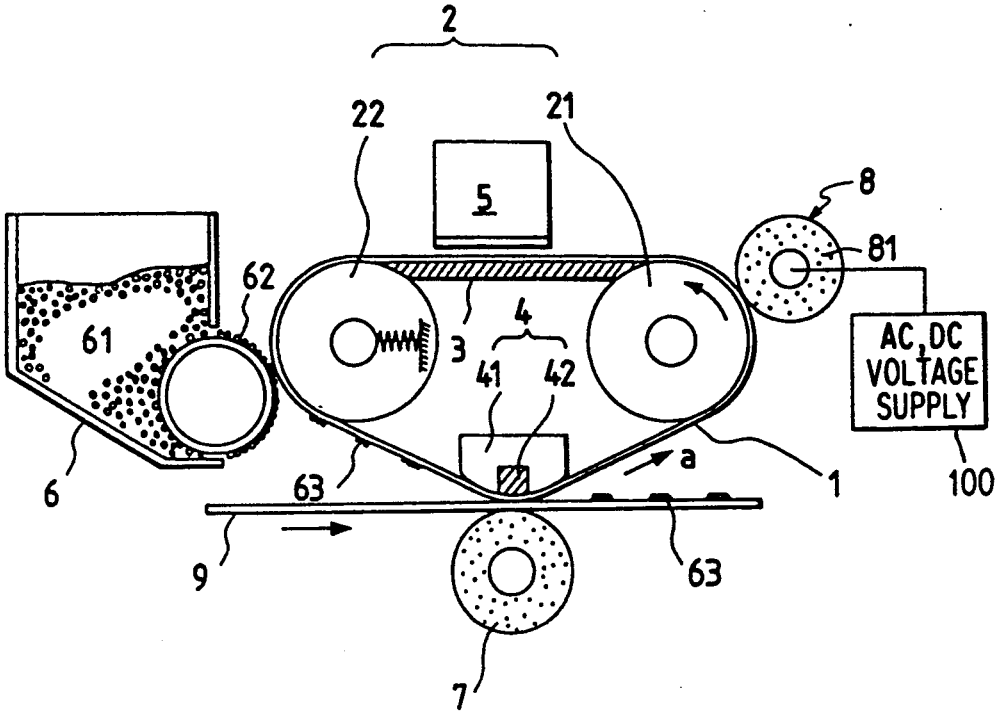
FIG. 1 is a longitudinal sectional view showing the construction of a printer constructed in accordance with a first embodiment of the invention.

FIG. 1 is a longitudinal sectional view showing the construction of a printer constructed in accordance with a first embodiment of the present invention.

An endless thin film 1, which has dielectric properties and bears a latent electrostatic image thereon, is supported by a transfer mechanism 2 including a drive roller 21 coupled with a drive source (not shown) and a tension roller 22, and is turned in the direction of an arrow "a". A back electrode 3 and a heater 4 are disposed within the loop of the endless film 1. Outside the loop of the endless film 1 are disposed an ion-current control head 5, a developing unit 6, a pressure roller 7, and a charge removal unit 8. The ion-current control head 5, which performs the function of an electrostatic recording head, is located in opposition to the back electrode 3. The developing unit 6 is located in opposition to the tension roller 22. The pressure roller 7 is opposed to the heater 4. The charge removal unit 8 is opposed to the drive roller 21. The ion-current control head 5 applies ion beams selectively to the endless film 1 so that a latent electrostatic image is formed on the endless film. The latent image is rendered visible with toner particles by the developing unit 6. The toner image formed is heated and fused by the heater 4 through the endless film 1. At the same time, the toner image is transferred to a recording medium, such as paper, and the transferred toner image is pressed against the medium to be permanently fixed thereon. After the fixing process, the discharge unit 8 removes the charge left on the surface of the endless film 1.

The latent-image bearing film 1 is an endless film composed of two layers, a base layer and a surface layer. The base layer is a polyamide film 20 μm thick, which has properties of a high resiliency and small variation of its geometry at high temperatures. Such properties are required in order to obtain a stable transfer film. The surface layer is made of silicon resin or fluorine plastic, which exhibits excellent mold release characteristics when the toner is fused. The base layer is coated with the material to form the surface layer having a thickness of 10 μm thereover. The endless film 1, consisting of the base and surface layers, is capable of retaining ions thereon that are irradiated by the ion-current control head. The portion of the endless film 1 exposed to the ion-current can hold a surface potential of several tens to several hundred volts, which is high enough to develop the latent image in the next stage, with respect to the potential of the back electrode 3.

Figure 2:
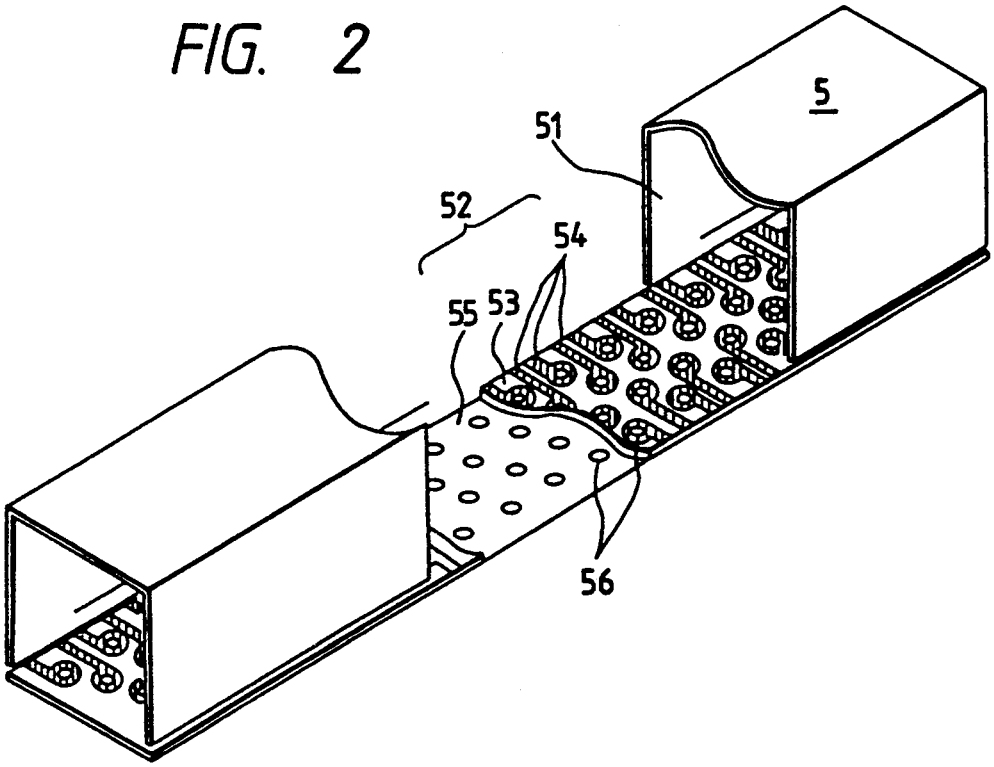
FIG. 2 is a partially broken perspective view of an ion-current control head 5 used in the printer of FIG. 1.

FIG. 2 is a partially broken perspective view of the ion-current control head 5. The ion-current control head 5 includes an ion generator 51 and an ion-current control plate 52 for controlling ion deposition on the endless film 1. The ion-current control plate 52 is constructed such that electrodes 54 and 55 are mounted on both sides of an insulating board 53, and holes 56, formed in the insulating board, are arrayed in zig-zag fashion. The number of holes 56 is equal to the number of recording dots. The ion-current control plate 52 is arranged parallel to the endless film 1, with the gap therebetween being in the range of 0.3 to 1.5 mm. In other words, the endless film 1, disposed directly under the ion-current control plate 52, is not curved with respect to the plate. Therefore, the projected images of the fluxes of ions projected through the holes 56 are all the same, irrespective of the locations of the holes.

A latent electrostatic image recorded on the endless film by the ion-current control head 5 is developed by the developing unit 6. The tension roller 22, which is opposed to the developing unit 6 with respect to the endless film 1 and which has a surface made of conductive material, for example, metal, performs two functions, one to transfer the endless film 1 and the other to provide a back electrode for the developing process. The back electrode 3, opposed to the ion-current control head 5, is connected to the tension roller 22, and the two electrodes are held at the same potential. The developing unit 6 contains toner 61 in the form of a resin powder containing coloring agent. A fixed amount of toner 61 is magnetically or electrostatically attracted to a sleeve 62 of the developing unit. The sleeve 62 bearing the toner 61 turns to bring the toner in close proximity to or in contact with the endless film 1. An electric field is developed between the endless film 1 and the sleeve 62, to which a preset voltage is applied. Under the electric field, the toner sticks onto the endless film 1, thereby to form a toner image 63.

The toner image 63 is heated and fused by the heater 4 through the endless film 1, while at the same time pressed against a record media 9 by the pressure roller 7. The media 9, together with the endless film, is transferred by the pressure roller 7. The fused toner image gets tangled with fibers of the record media 9 and is forced into the spaces among the fibers, generating an adhesive force between the media 9 and the toner image 63.

The surface layer of the endless film 1 is formed of silicon resin or fluorine plastic which, as described above, has excellent mold release characteristics. Accordingly, the adhesive force between the heated area of the endless film 1 and the fused toner image 63, as considered from the viewpoint of interfacial chemistry, is smaller than the cohesive force of the toner and the adhesive force between the media 9 and the toner image 63. Thus, the fused toner image 63 is completely transferred from the endless film 1 to the media 9. When the toner image 63 on the media 9, which is entangled with the fibers of the media and pushed into the spaces among the fibers, leaves the region where it is thermally influenced by the heat from the heater 4 and the toner temperature drops, the toner image 63 is hardened and fixed to the medium 9. In this way, the toner image 63 is transferred to and fused to the medium 9 all at once.

Generally, conventionally used photoreceptive materials used as a latent electrostatic image bearing members can be degraded by heat. It is for this reason that the heating device, such as a fusing unit, had to be installed spaced away from the photoreceptor. However, the present invention using the dielectric film 1, which has a high heat resistance, rather than a plain photoreceptive material, as the latent electrostatic image bearing member, allows the latent electrostatic image bearing member to be directly heated. This realizes a one-stage transferring/fixing operation.

The media 9 is transferred while being nipped between the pressure roller 7 and the endless film 1. There is no need for using a rotating heated roller containing a bar-like halogen lamp for the heater 4.

In this embodiment, the toner image 63 is heated and fused in such a manner that a ceramic heater 42 supported by a thermal insulating resin 41 is brought into contact with the endless film 1. The heat capacity of the heater using the ceramic heater 42 is smaller than that of a heater using the heated roller. Accordingly, the former is superior to the latter in that the warm-up time required to increase temperature of the heater 4 to a preset temperature is short, and the power consumption of the image forming apparatus is reduced.

Conductive toner provides easy development, but presents a difficulties with respect to its electrostatic transfer to plain paper. For this reason, use of only special paper, e.g., high resistance paper, has conventionally been permitted for the recording medium. In other words, plain paper cannot be used. However, it is noted that in this embodiment, since no electrostatic force is used for the image transfer, plain paper can be used, even if a conductive toner is used.

In this embodiment, since no toner is left on the endless film 1, neither a cleaning blade for scraping the residual toner from the endless film nor a receptacle for receiving waste toner is required.

In the fixing process using only pressure and not heat, a strong linear pressure load must be applied to the medium, as a result of which the medium bearing the image thus fixed has an unnatural luster. It is noted though that in this embodiment, the transfer and fixing processes of the toner image concurrently progress while the toner image is heated and fused. Therefore, the medium has no unnatural luster.

The discharge unit 8 is a conductive rubber roller 81 disposed in opposition to the drive roller 21. The surface of the drive roller 21 is made of conductive material, similar to the tension roller 22, and is connected to the back electrode 3, while being held at the same potential. An AC voltage of 300 to 1000 V in amplitude and 400 to 2000 Hz in frequency superposed on a DC voltage of 50 to 400 V is applied to the conductive rubber roller 81, by voltage supply 100 with the surface potential of the tension roller 22 as a reference potential. With the application of such voltage, the surface potential of the endless film 1 bearing the latent electrostatic image is initialized. In the alternative conductive rubber roller covered with an insulating layer may be used for the discharge unit.

Figure 3:
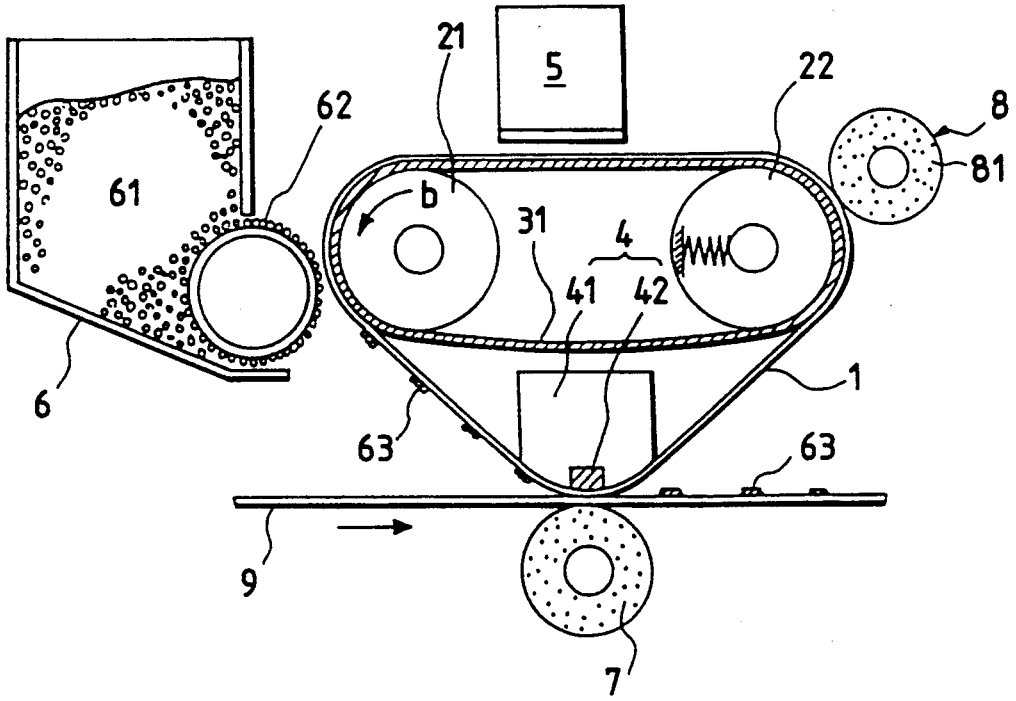
FIG. 3 is a longitudinal sectional view showing a second embodiment of the invention.

FIG. 3 is a longitudinal sectional view showing a second embodiment of the present invention.

A conductive rubber belt 31, which serves also as a back electrode, is wound around the drive roller 21 and the tension roller 22. The endless film 1 bearing the latent electrostatic image is applied to the rubber belt wound around the rollers. In the first embodiment, the tension roller 22 is disposed at a location opposed to the developing unit 6, and the drive roller 21 is disposed at a location opposed to the discharge unit 8.

In the second embodiment, however, the drive roller 21 is installed at the location where the tension roller 22 is installed in the first embodiment, and vice versa. The rubber belt 31 also serving as the back electrode is driven in the direction of an arrow "b" by the drive roller 21. The rubber belt 31 is tensioned in the region facing the ion-current control head 5. The endless film 1 is transferred between the rollers 21 and 22 while being in a close contact with the rubber belt 31, thereby stably maintaining a fixed gap between the ion-current control plate 52 of the head 5 and the endless film 1.

The conductive rubber belt 31 has two functions, one to transfer the endless film 1 and the other to act as the back electrode in the stages of forming the latent image, development thereof, and discharge of the endless films. Accordingly, there is no need for using a conductive material for the surfaces of the drive roller 21 and the tension roller 22.

The remaining construction and operation of the second embodiment is substantially the same as the first embodiment, and hence no further description thereof will be given here.

Figure 4:
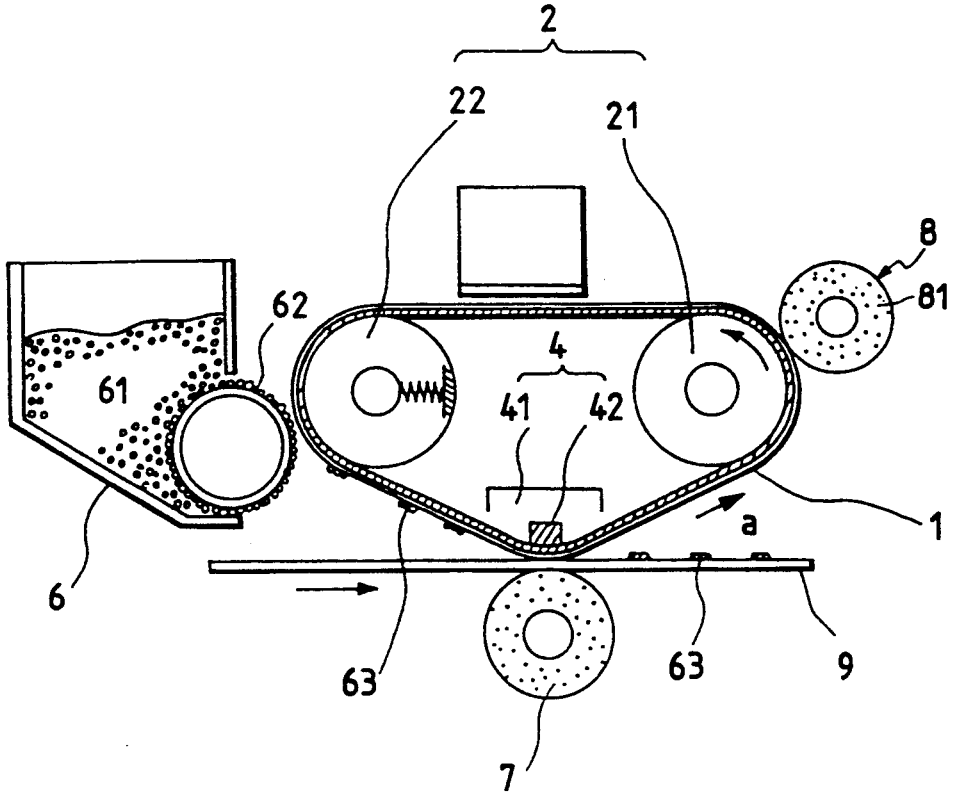
FIG. 4 is a longitudinal sectional view showing a third embodiment of the present invention.

FIG. 4 is a longitudinal sectional view showing a third embodiment of the invention.

The endless film 1 bearing the latent electrostatic image used in this embodiment is constructed such that an endless film, which has a thickness of 30 μm thick and is formed of copper or nickel through an electroprinting process, is coated with silicon resin or fluorine plastic to form a resin layer having a thickness of 20 μm. The latent electrostatic image can be formed without the additional back electrode. The surfaces of the drive roller 21 and the tension roller 22, which are respectively disposed opposed to the discharge unit and the developing unit, are not necessarily made of conductive material. The remaining construction and operation of the present third embodiment is substantially the same as the first embodiment, and hence a further detailed description will be omitted.

Figure 5:
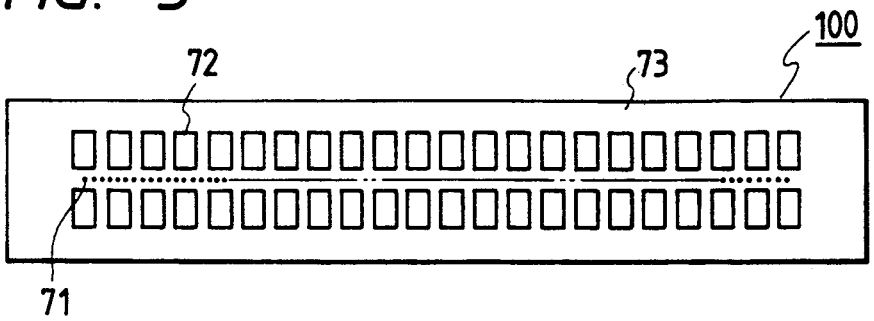
FIG. 5 is a plane view of a multistylus-head used in a fourth embodiment of the present invention.
Figure 6:
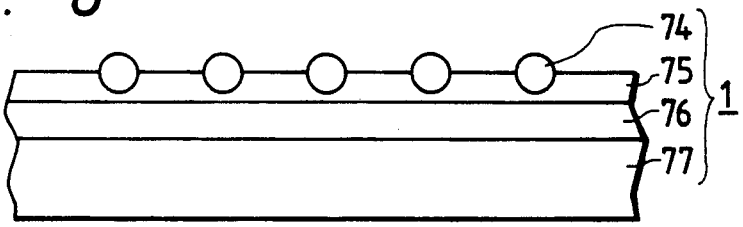
FIG. 6 is a longitudinal sectional view showing an endless film, on which is formed a latent electrostatic image, used in the fourth embodiment of the present invention.
Figure 7:
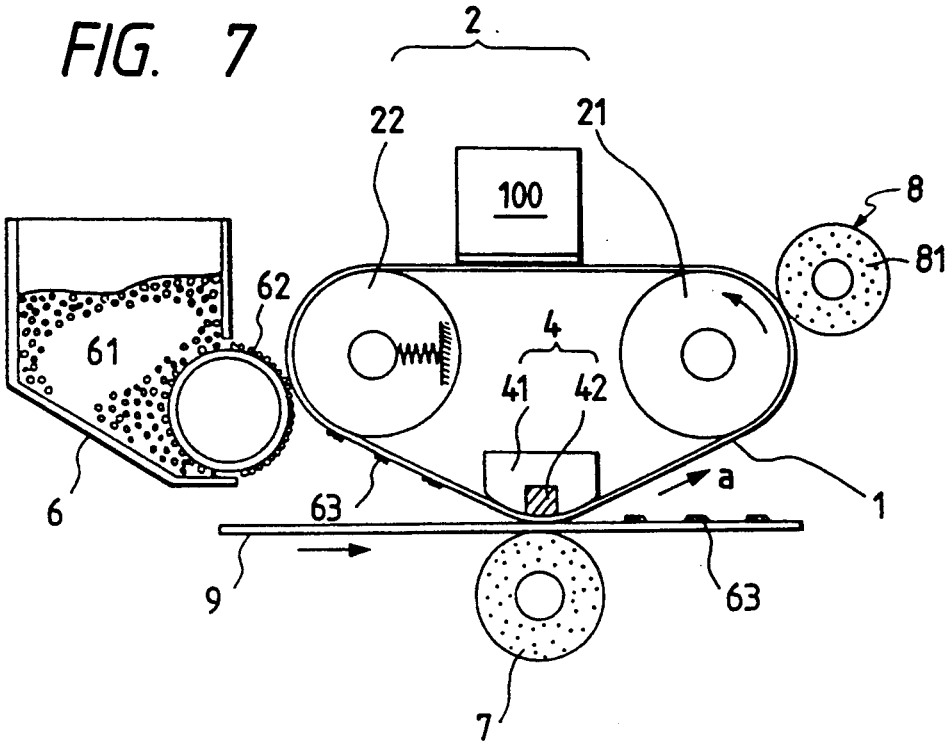
FIG. 7 is a longitudinal sectional view showing the construction of a printer constructed in accordance with a fourth embodiment of the invention.

FIGS. 5–7 shows a fourth embodiment of the present invention. FIG. 5 shows a plane view of a multistylus-head 100 used in the fourth embodiment. In the multistylus-head 100, main electrodes 71 and auxiliary electrodes 72 are embedded in the structural material 73 having a dielectric character, in such a manner that the main electrodes 71 are aligned at a predetermined interval on a single line and the auxiliary electrodes 72 are arranged at a predetermined interval in two lines. The auxiliary electrodes 72 are disposed on both sides of the main electrodes 71 in parallel at a predetermined interval. Each end surface of the main electrodes 71, the auxiliary electrodes 72 and the structural material 73 lies in the same plane. FIG. 6 shows a cross-sectional view of an endless film 1, on which is formed a latent electrostatic image, used in the fourth embodiment of the present invention. The endless film 1 comprises a dielectric layer 75, an electroconductive layer 76 and a base layer 77. One side surface of the base layer 77 is bonded to one side surface of the electroconductive layer 76 having a lower resistance character (surface resistance $10^4$-$10^{10}\Omega$), and the other side surface of the electro-conductive layer 76 is bonded to one side surface of the dielectric layer 75. Particles 74 having a dielectric character are adhered to the other side surface of the dielectric layer 75. In FIG. 7, the endless film 1 bearing the latent electrostatic image is mounted in such a manner that the base layer 77 is directed to an inner side, that is, the base layer is brought in contact with the drive roller 21, tension roller 22 and the heater 4. In addition, the multistylus-head 100 is disposed so as to direct the sectional surface shown in FIG. 5 downward, and the multistylus-head 100 is confronted with a surface of the dielectric layer 75 of the endless film 1 so as to bring the head 100 into contact with the surface of the layer 75. The remaining construction and operation of the present embodiment are substantially the same as those of the first embodiment, and hence a further detailed description will be omitted.

An electrostatic latent image is formed by utilizing a well-known technique, for example, described in "the Voltage Coincident Method, Matrix AND, and so on" (Head Copy Technology, edited by Japan Industrial Technorogie Center, 1981). Development is conducted by applying a predetermined voltage to the sleeve 62. A voltage applied to the sleeve 62 when the base layer 77 has an electro-conductive character is different from a voltage applied to the sleeve 62 when the base layer has a dielectric character. Of course, the voltage is selected in such a manner that the voltage applied to the sleeve 62 when the base layer 77 has a dielectric character is larger than the voltage applied to the sleeve 62 when the base layer 77 has a conductive character. The remaining construction and operation (Transfer Mechanism and so on) of the present embodiment are substantially the same as the first embodiment, and hence a further detailed description will be omitted.

In the fourth embodiment of the present invention, the multistylus-head with the same plane control is used, it may possible to use a multistylus-head with a single plane control or a double plane control (as described by Tokurou Yasuda, A characteristic of a electrostatic recording paper, edited by Electrostatic Academy, 9, 4, page 246–256, 1986).

In the image forming apparatus of the invention, the latent electrostatic image forming head is disposed in close proximity to a planar stretch of the endless belt bearing the latent electrostatic image. By virtue of this construction, the dots which make up the latent electrostatic images, which are formed by respective recording electrodes having holes each forming one dot as a picture element, are uniform in size and shape ever if the recording electrodes are arrayed in a zig-zag fashion.

In the invention, the latent electrostatic image bearing member is formed of an endless film having dielectric and heat-resistance properties, not a photoreceptor. Therefore, the image bearing member may be directly heated, so that transferring and fixing of the toner image to the media can be concurrently performed.

Because, with the invention, the transferring and fixing operations are performed at the time when the toner image is heated and fused, neither a transfer unit nor a fixing unit separated by a prescribed distance therebetween need be provided. Further, in the invention, no toner is left on the endless film after the transfer of the latent image. This eliminates the need of a cleaning blade or a waste toner receptacle. In addition, no space for the optical path is needed, leading to a reduction of the overall size of the image forming apparatus.

What is claimed is:

1. An image forming apparatus comprising:

an endless loop of a thin film for bearing a latent electrostatic image, said endless film being made of a material having both heat-resistant and dielectric properties;

a transfer mechanism for driving said endless loop of said thin film along a closed path;

a latent electrostatic image recording head, disposed outside said loop of said thin film, for recording a latent electrostatic image on said thin film;

a developing unit, disposed outside said loop of said thin film, for developing the latent electrostatic image on said endless film by placing toner particles in close proximity to or bringing toner particles into contact with said thin film;

a back electrode disposed inside said loop of said thin film;

a pressure roller disposed outside of said loop of said thin film in opposition to an outside surface of said thin film;

a discharge unit, disposed outside said loop of said thin film, for discharging the latent electrostatic image; and a heater disposed inside of said loop of said thin film, said heater being in opposition to said pressure roller, said thin film passing between said heater and said pressure roller, a nipped area being defined by an area of contact between a recording sheet and said pressure roller when the recording sheet is passed between said thin film and said pressure roller, said heater being in contact with a portion of an inside surface of said thin film which is in opposition to said nipped area, all other portions of said inside surface being in a non-contact state with respect to said heater.

2. The image forming apparatus of claim 1, wherein said thin film is formed of a base layer of a polyamide film and a surface layer made of a material selected from the group consisting of silicon resin and fluorine plastic.

3. The image forming apparatus of claim 2, wherein said base layer has a thickness of approximately 20 μm and said surface layer has a thickness of approximately 10 μm.

4. The image forming apparatus of claim 1, wherein said recording head comprises a planar ion-current control plate having a plurality of ion-ejecting holes formed therein, said ion-current control plate being disposed adjacent to and parallel to a planar run of said loop of said thin film.

5. The image forming apparatus of claim 4, wherein there is a gap in a range of 0.3 to 1.5 mm between said ion-current control plate and said thin film.

6. The image forming apparatus of claim 1, wherein said back electrode comprises a conductive planar plate-like member disposed inside said loop of said thin film opposite said recording head.

7. The image forming apparatus of claim 6, wherein said transfer mechanism comprises a drive roller and a tension roller.

8. The image forming apparatus of claim 7, wherein said tension roller has a conductive outer surface at a potential equal to a potential of said back electrode.

9. The image forming apparatus of claim 8, wherein said developing unit comprises a sleeve disposed outside said loop of said thin film opposite said tension roller, said sleeve being at a potential sufficiently different from said potential of said tension roller to create an electric field between said conductive sleeve and said tension roller to transfer toner particles from said sleeve to said thin film.

10. The image forming apparatus of claim 1, wherein said heater is a ceramic heater supported by a thermal insulating resin.

11. The image forming apparatus of claim 6, wherein said discharge unit comprises a conductive rubber roller disposed opposite said drive roller.

12. The image forming apparatus of claim 11, wherein an AC voltage 100 to 1000 volts in amplitude and 400 to 2000 Hz in frequency superposed on a DC voltage 50 to 400 volts in amplitude is applied to said conductive rubber roller.

13. The image forming apparatus of claim 1, wherein said back electrode comprises a conductive rubber belt, said endless loop of said thin film being applied over said conductive rubber belt.

14. The image forming apparatus of claim 13, wherein said transfer mechanism comprises a drive roller and a tension roller, said tension roller being disposed opposite said discharge unit and said drive roller being disposed opposite said developing unit.

15. The image forming apparatus of claim 14, wherein said developing unit comprises a sleeve disposed outside said loop of said thin film opposite said driver roller, said sleeve being at a potential sufficiently different from said potential of said rubber belt to create an electric field between said conductive sleeve and said rubber belt to transfer toner particles from said sleeve to said thin film.

16. An image forming apparatus comprising:

an endless loop of thin film for bearing a latent electrostatic image, said endless film comprising a conductive film and a dielectric layer formed on said conductive film;

a transfer mechanism for driving said endless loop of said thin film along a closed path;

a latent electrostatic image recording head, disposed outside said loop of said thin film, for recording a latent electrostatic image on said thin film;

a developing unit, disposed outside said loop of said thin film, for developing the latent electrostatic image on said thin film by placing toner particles in close proximity to or bringing toner particles into contact with said thin film;

a pressure roller disposed outside of said loop of said thin film in opposition to an outside surface of said thin film;

a discharge unit, disposed outside said loop of said thin film, for discharging the latent electrostatic image; and a heater disposed inside of said loop of said thin film, said heater being in opposition to said pressure roller, said thin film passing between said heater and said pressure roller, a nipped area being defined by an area of contact between a recording sheet and said pressure roller when the recording sheet is passed between said thin film and said pressure roller, said heater being in contact with a portion of an inside surface of said thin film which is in opposition to said nipped area, all other portions of said inside surface being in a non-contact state with respect to said heater.

17. The image forming apparatus of claim 16, wherein said thin conductive film is formed from a material selected from the group consisting of copper and nickel, and said thin dielectric film is formed from a material selected from the group consisting of silicon resin and fluorine plastic.

18. The image forming apparatus of claim 17, wherein said conductive film has a thickness of approximately 30 μm and said dielectric film has a thickness of approximately 20 μm.

19. The image forming apparatus of claim 16, wherein said recording head comprises a planar ion-current control plate having a plurality of ion-ejecting holes formed therein, said ion-current control plate being disposed adjacent a planar run of said loop of said thin film.

20. The image forming apparatus of claim 19, wherein there is a gap in a range of 0.3 to 1.5 mm between said ion-current control plate and said thin film.

21. The image forming apparatus of claim 16, wherein said transfer mechanism comprises a drive roller and a tension roller.

22. The image forming apparatus of claim 21, wherein said developing unit comprises a sleeve disposed outside said loop of said thin film opposite said tension roller, said sleeve being at a potential sufficiently different from the potential of said conductive film to create an electric field between said conductive sleeve and said conductive film to transfer toner particles from said sleeve to said thin film.

23. The image forming apparatus of claim 16, wherein said heater comprises a ceramic heater supported by a thermal insulating resin.

24. The image forming apparatus of claim 21, wherein said discharge unit comprises a conductive rubber roller disposed opposite said drive roller.

25. The image forming apparatus of claim 24, wherein an AC voltage 100 to 1000 volts in amplitude and 400 to 2000 Hz in frequency superposed on a DC voltage 50 to 400 volts in amplitude is applied to said conductive rubber roller.

26. An image forming apparatus comprising:

an endless loop of a thin film, said thin film comprising a polyamide film base layer having a surface layer disposed thereon, said surface layer being made of a material selected from the group consisting of silicon resin and fluorine plastic, a thickness of said base layer being approximately 20 μm, and a thickness of said surface layer being approximately 10 μm;

a transfer mechanism movably supporting said endless loop so as to drive said thin film loop along a closed path;

a latent electrostatic image recording head disposed outside of said loop so as to selectively record an electrostatic latent image on said surface layer of said thin film;

a developing unit disposed outside of said loop so as to develop said latent image by placing toner particles in proximity to said surface layer of said thin film;

a conductive planar plate-like back electrode disposed inside of said loop at a position which is in opposition to said recording head;

a heater disposed inside of said loop;

a pressure roller disposed outside of said loop in opposition to said heater; and a discharge unit disposed outside of said loop so as to discharge said surface layer of said thin film and remove said latent image.

* * * * *